US009334704B2

(12) United States Patent
Mineo et al.

(10) Patent No.: US 9,334,704 B2
(45) Date of Patent: May 10, 2016

(54) POWERED WELLBORE BAILER

(71) Applicant: Halliburton Energy Services, Inc., Houston, TX (US)

(72) Inventors: Richard Mineo, Richardson, TX (US); Dominick Joseph Bellotte, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/429,260

(22) PCT Filed: Sep. 27, 2012

(86) PCT No.: PCT/US2012/057517

§ 371 (c)(1),
(2) Date: Mar. 18, 2015

(87) PCT Pub. No.: WO2014/051588

PCT Pub. Date: Apr. 3, 2014

(65) Prior Publication Data

US 2015/0240583 A1 Aug. 27, 2015

(51) Int. Cl.

| | |
|---|---|
| ***E21B 27/04*** | (2006.01) |
| ***E21B 34/06*** | (2006.01) |
| *E21B 34/00* | (2006.01) |

(52) U.S. Cl.

CPC ..... *E21B 27/04* (2013.01); *E21B 34/06* (2013.01); *E21B 34/063* (2013.01); *E21B 2034/002* (2013.01)

(58) Field of Classification Search

CPC ..... E21B 27/02; E21B 27/04; E21B 34/06; E21B 34/063; E21B 2034/002

See application file for complete search history.

(56) References Cited

U.S. PATENT DOCUMENTS

| | | | | | |
|---|---|---|---|---|---|
| 2,141,179 | A | * | 12/1938 | Ennis | 166/74 |
| 2,187,845 | A | * | 1/1940 | Tatalovich | 166/104 |
| 3,379,251 | A | * | 4/1968 | Bohn | 166/286 |
| 3,709,296 | A | * | 1/1973 | Glenn, Jr. | 166/253.1 |
| 4,037,662 | A | | 7/1977 | Bowling | |
| 4,415,269 | A | * | 11/1983 | Fraser | B01F 13/00 222/135 |
| 4,421,166 | A | * | 12/1983 | Cain | 166/162 |
| 4,516,911 | A | | 5/1985 | Senghaas et al. | |
| 4,739,829 | A | * | 4/1988 | Brunner | 166/63 |
| 5,392,856 | A | * | 2/1995 | Broussard et al. | 166/285 |

(Continued)

FOREIGN PATENT DOCUMENTS

| | | | |
|---|---|---|---|
| GB | 682742 | A * | 11/1952 |
| GB | 2409691 | | 7/2006 |

(Continued)

OTHER PUBLICATIONS

Authorized Officer Philippe Becamel, PCT International Preliminary Report on Patentability, PCT/US2012/057517, Apr. 9, 2015, 7 pages.

(Continued)

*Primary Examiner* — Jennifer H Gay

(74) *Attorney, Agent, or Firm* — Alan Bryson; Fish & Richardson P.C.

(57) ABSTRACT

A wellbore bailer has a rotary motor coupling, a cylinder having an open end, and a pump in the cylinder coupled to the rotary motor coupling and configured to pump fluid when rotated via the coupling. A closure of the bailer is changeable between sealing and allowing flow through the open end.

19 Claims, 3 Drawing Sheets

(56) References Cited

U.S. PATENT DOCUMENTS

| | | | | |
|---|---|---|---|---|
| 5,482,117 | A | 1/1996 | Kolpak et al. | |
| 6,161,631 | A | 12/2000 | Kennedy et al. | |
| 6,357,682 | B1 | 3/2002 | Hext | |
| 6,406,255 | B1 | 6/2002 | Angelle | |
| 6,464,012 | B1 | 10/2002 | Strickland | |
| 6,615,924 | B2 * | 9/2003 | Rice | 166/369 |
| 6,698,521 | B2 * | 3/2004 | Schrenkel et al. | 166/369 |
| 6,989,092 | B1 | 1/2006 | Pratt | |
| 7,287,591 | B2 * | 10/2007 | Campbell | 166/305.1 |
| 7,493,969 | B2 | 2/2009 | Burnett et al. | |
| 7,575,069 | B2 | 8/2009 | Pavlik | |
| 7,836,955 | B2 | 11/2010 | Creighton | |
| 8,109,331 | B2 | 2/2012 | Lynde et al. | |
| 8,113,282 | B2 * | 2/2012 | Picou | 166/278 |
| 8,118,172 | B2 | 2/2012 | Burnett | |
| 8,141,639 | B2 * | 3/2012 | Gartz et al. | 166/286 |
| 8,813,841 | B2 * | 8/2014 | Carisella | 166/286 |
| 2002/0134554 | A1 | 9/2002 | Schrenkel et al. | |
| 2002/0144821 | A1 * | 10/2002 | Rice | 166/369 |
| 2006/0102336 | A1 * | 5/2006 | Campbell | 166/65.1 |
| 2006/0254765 | A1 * | 11/2006 | Pfeiffer | E21B 43/40 166/246 |
| 2010/0122814 | A1 * | 5/2010 | Picou | 166/278 |
| 2010/0155054 | A1 | 6/2010 | Innes et al. | |
| 2010/0175889 | A1 * | 7/2010 | Gartz et al. | 166/376 |
| 2011/0174068 | A1 * | 7/2011 | Irani et al. | 73/152.23 |
| 2012/0090835 | A1 * | 4/2012 | Kefi | 166/252.6 |
| 2012/0090851 | A1 * | 4/2012 | Irwin et al. | 166/369 |
| 2012/0097385 | A1 | 4/2012 | Villareal et al. | |
| 2012/0160483 | A1 * | 6/2012 | Carisella | 166/270 |
| 2012/0247755 | A1 * | 10/2012 | Colon | E21B 27/02 166/168 |
| 2014/0318782 | A1 * | 10/2014 | Bourque | 166/286 |
| 2015/0240583 | A1 * | 8/2015 | Mineo et al. | E21B 27/04 |

FOREIGN PATENT DOCUMENTS

| | | | |
|---|---|---|---|
| WO | WO 03036020 | A1 * | 5/2003 |
| WO | WO 2014084807 | A1 * | 6/2014 |

OTHER PUBLICATIONS

Otis, "Tubing Perforators and Bailers" Subsurface Wireline Equipment, 1989, p. 270.

PCT International Search Report and Written Opinion of the International Searching Authority, PCT/US2012/057517, Apr. 25, 2013, 10 pages.

United Kingdom Intellectual Property Office, GB Application No. GB1503723.7, Oct. 15, 2015, 4 pages.

United Kingdom Intellectual Property Office, Examination Report under Section 18(3), GB Application No. GB1503723.7, Feb. 11, 2016, 2 pages.

* cited by examiner

POWERED WELLBORE BAILER

CROSS-REFERENCE TO RELATED APPLICATIONS

This application is a 371 U.S. National Phase Application of and claims the benefit of priority to International Patent Application Serial No. PCT/US2012/057517, filed on Sep. 27, 2012, the contents of which are hereby incorporated by reference.

BACKGROUND

A bailer tool, also sometimes called a sand bailer, is a well tool used to remove sand and other small pieces of debris from inside a tubing or casing of the well. For example, a bailer tool can be used to clean debris out of a fish neck prior to gripping the fish neck. Some conventional bailer tools are pump-type tools that have a piston in cylinder and a check valve at the mouth of the cylinder. The tool is carried into the well on a wire (e.g., slickline). The piston is lifted in the cylinder via the wire, and sucks debris entrained in liquid into the cylinder through the check valve. The check valve closes, and seals the debris inside the cylinder. The piston may be lifted and lowered, via the wire, multiple times until the debris has been removed or the cylinder is full. Then, the bailer tool is retrieved to the surface on the wire.

A dump bailer tool operates oppositely to deposit material, typically cement, in the wellbore. For example, a dump bailer tool can be used to deposit cement onto a plug in the wellbore, to permanently place the plug. Some conventional bailer tools include a rupture disk that seals the material to be deposited inside a cylinder. A plunger is fixed at the bottom of the cylinder by shear pins. The dump bailer tool is carried into the well on a wire (e.g., slickline), and jarred down onto the plug or other subsurface device that the material will be deposited on. The jarring breaks the shear pins and drives the plunger up through the rupture disk, breaking the rupture disk. The material to be deposited flows from the cylinder into the wellbore. Then, the dump bailer tool is retrieved to the surface on the wire.

DESCRIPTION OF DRAWINGS

Like reference symbols in the various drawings indicate like elements.

DETAILED DESCRIPTION

Figure 1:
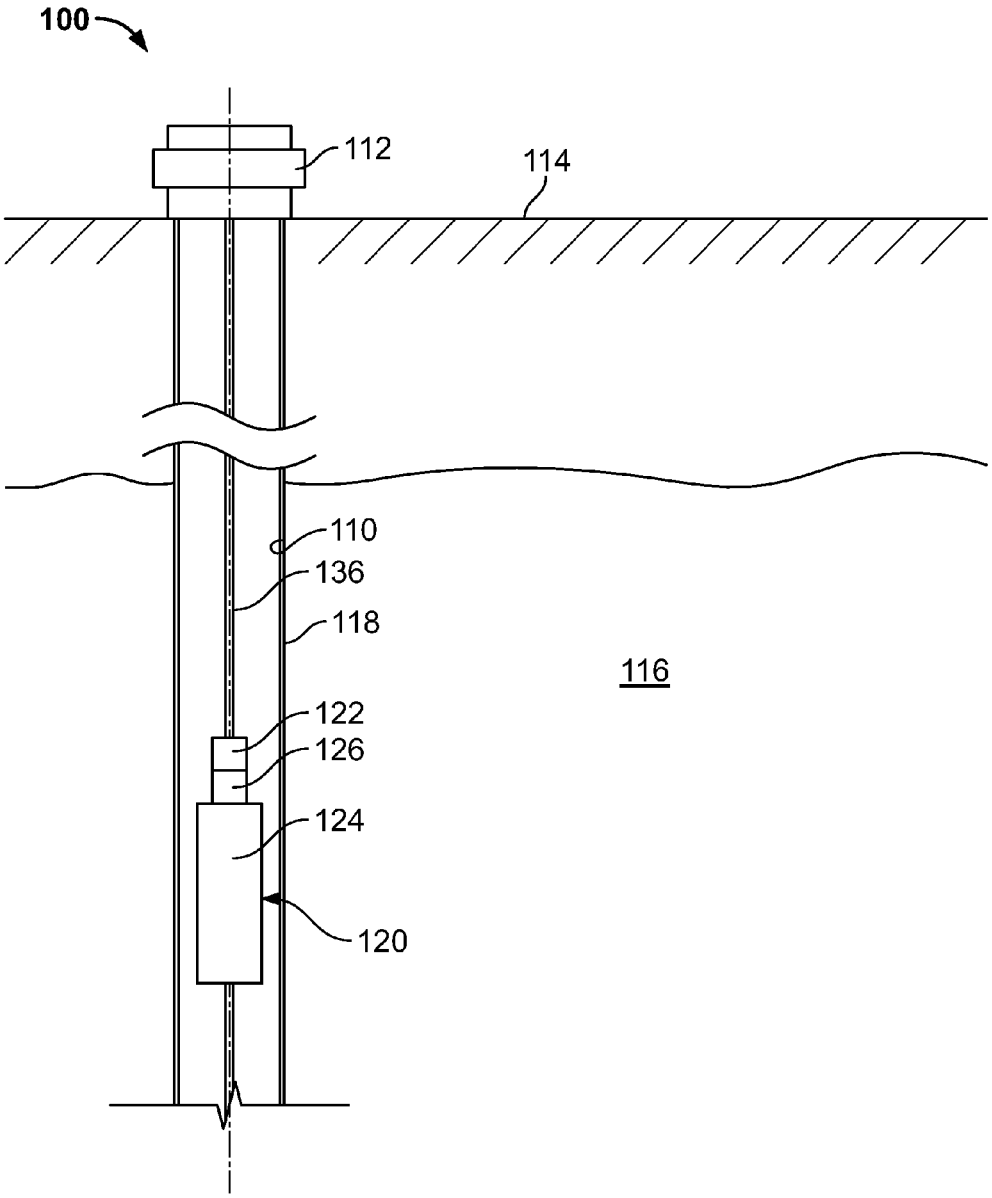
FIG. 1 is a side cross-sectional view of a well having a wellbore bailer system.

Referring first to FIG. 1, an example well 100 is shown prior to completion. The well 100 includes a substantially cylindrical wellbore 110 that extends from a wellhead 112 at the surface 114 downward into the Earth into one or more subterranean zones of interest 116 (one shown). A portion of the wellbore 110 extending from the wellhead 112 to the subterranean zone 116 is shown lined with lengths of tubing, called casing 118, that is cemented into place. In other instances, the casing 118 can be omitted or the casing can extend to the termination of the wellbore 110. The depicted well 100 is a vertical well, having a substantially vertical wellbore portion that extends from the surface 114 to the subterranean zone 116. The concepts herein, however, are applicable to many other different configurations of wells, including horizontal wells, slanted or otherwise deviated wells, and multilateral wells.

A wellbore bailer system 120 is shown as having been lowered from the surface 114 into the wellbore 110. The bailer system 120 depends into the well on a wire 136, such as a slickline, wireline, e-line and/or other wire. The bailer system 120 includes a downhole type motor 122 coupled to a bailer tool 124. The downhole motor 122 drives the bailer tool 124. In certain instances, the downhole motor 122 is a rotary motor that drives a male or female output shaft to rotate. The output shaft is, in turn, coupled to the bailer tool 124 and causes a component of the bailer tool 124 to rotate. The bailer tool 124 is coupled to the motor 122 by a rotary motor coupling 126 that couples the rotating component of the bailer tool 124 to the output shaft of the motor 122. In certain instances, the coupling 126 can drive the bailer tool 124 at a ratio of 1:1 with the motor 122, or the coupling 126 can have a gear system to gear up or gear down the motor 122 to drive the bailer tool 124 at a different ratio. Notably, although discussed in connection with being lowered into the well on a wire, the wellbore bailer system 120 could be lowered into the well on tubing (e.g., jointed tubing and/or coiled tubing).

The downhole motor 122 can be powered with electricity from the wire (e.g., if wireline) and/or include a battery or other power storage. The motor 122 operates in response to a signal from the surface 144, a signal from a downhole sensor and/or on a timer. For example, in certain instances, the motor 122 is actuated to operate the bailer tool 124 at a specified depth, determined in response to sensing a specified pressure with a downhole pressure sensor associated with the motor 122. In another example, the motor 122 is actuated to operate the bailer tool 124 after a specified time delay selected based on the expected time to depth of the bailer tool 124, and to operate the bailer tool 124 for a specified time thereafter. In yet another example, an operator supplies power and/or an actuation signal over the wire to turn the bailer tool 124 on or off. Still other examples exist. In certain instances, the motor 122 can be that of a DPU® Downhole Power Unit made by Halliburton Energy Services, Inc.

In certain instances, the bailer tool 124 is of a type used to remove sand and other small pieces of debris from inside a tubing or casing of the well. Generally speaking, the bailer tool 124 sucks debris entrained in liquid into its interior through a valve closure. The valve closes, and seals the debris inside, and when the debris has been removed or the cylinder is full, the bailer tool 124 is retrieved to the surface on the wire 136.

In certain instances, the bailer tool 124 is a dump bailer tool that carries a flowable material, such as cement and/or other material, into the wellbore in an interior of the tool. The material is retained in the dump bailer tool 124 with a valve closure. The dump bailer tool 124 is then actuable to deposit the material in the wellbore. After the material flows from the interior of the tool 124 into the wellbore 110, the dump bailer tool 124 is retrieved to the surface on the wire 136.

FIGS. 2-5 show examples of tools that could be used as bailer tool 124.

Figure 2:
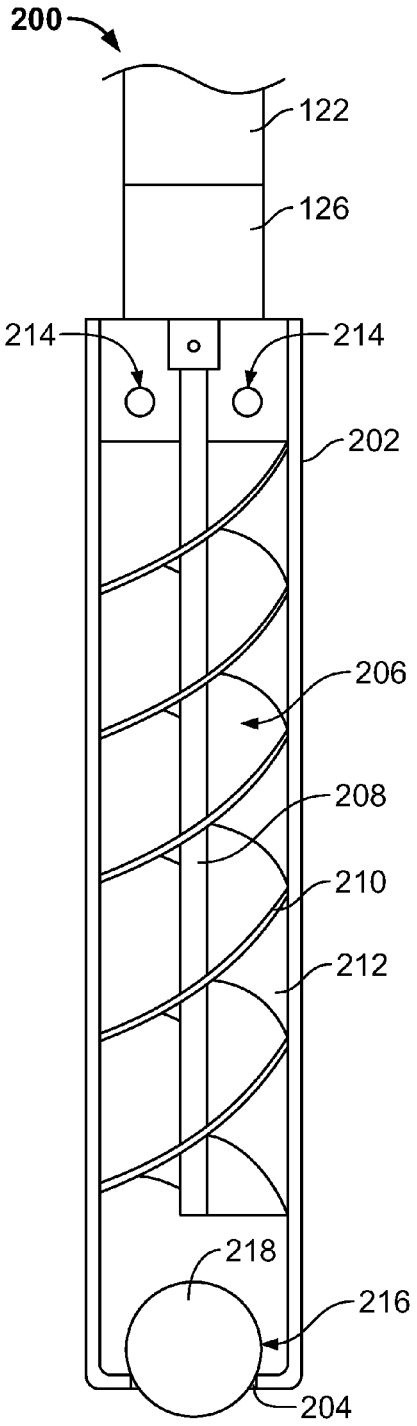
FIG. 2 is a half, side cross-sectional view of an example wellbore bailer tool.

FIG. 2 is a half, side cross-sectional view of an example bailer tool 200 that can be used as bailer tool 124. The bailer tool 200 is of a type used to remove sand and other small pieces of debris from inside a tubing or casing of the well. The bailer tool 200 includes a cylinder housing 202 defining an interior chamber and having an open end 204. A pump 206 is provided in the cylinder housing 202 and is coupled to the rotary motor coupling 126 and, in turn, the motor 122. The pump 206 is configured to pump fluid into the cylinder housing 202 when rotated by the motor 122. The pump 206 is configured as an auger screw having a central shaft 208 carrying a helical blade 210 that extends outward from the shaft 208. The outer perimeter of the helical blade 210 seals with an interior wall of the cylinder housing 202 (e.g., by close passage to the interior wall and/or with seals along the perimeter of the blade 210), and defines a helical fluid chamber 212 substantially the length of the pump 206. As the pump 206 is rotated by the motor 122, it draws fluid, and solids entrained in the fluid, into the interior of the cylinder housing 202. The pump 206 is rotated at a rate such that the solids tend to settle out in the interior of the cylinder housing 202 and substantially fluid is pumped upward and exits through one or more vent holes 214 (two shown) near the upper end of the cylinder housing 202. A closure 216 in the open end 204 is changeable between sealing against flow through the open end 204 and allowing flow through the open end 204. In certain instances, the closure 216 is a check valve oriented to allow fluid and entrained solids to enter the cylinder housing 202 when the pump 206 is rotated, and to close to seal fluid and solids in the cylinder housing 202 when the pump 206 is stopped. For example, the check valve is configured as a ball 218 having a larger diameter than and that seals against the diameter of the open end 204. Other examples of closures and/or check valves are within the concepts herein.

In operation, the bailer tool 200 is run into the wellbore on wire to a specified depth. When the motor 122 is rotated, it turns the pump 206. The pump 206 pumps fluid and debris into the cylinder housing 202 through the closure 216. When the motor 122 stops, the closure 216 closes and seals the debris inside the cylinder housing 202. Thereafter, the bailer tool 200 can be withdrawn to the surface and emptied.

Figure 3:
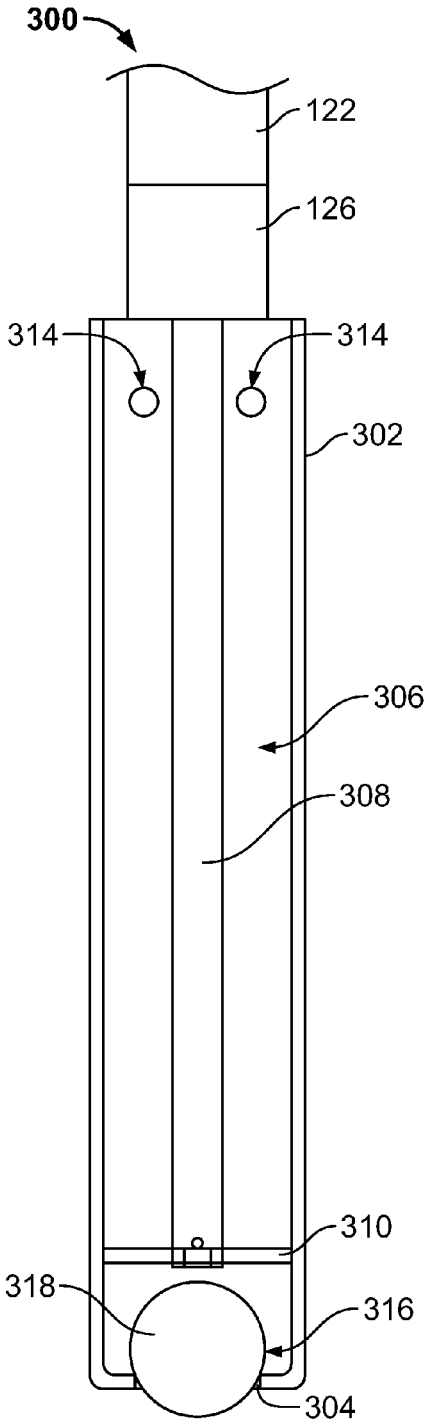
FIG. 3 is a half, side cross-sectional view of another example bailer tool.

FIG. 3 is a half, side cross-sectional view of another example bailer tool 300 that can be used as bailer tool 124. Like the bailer tool 200 of FIG. 2, bailer tool 300 is of the type used to remove sand and other small pieces of debris from inside a tubing or casing of the well. The bailer tool 300 includes a cylinder housing 302 defining an interior chamber and having an open end 204. As above, a pump 306 is provided in the cylinder housing 302 and is coupled to the rotary motor coupling to 126 and, in turn, the motor 122. The pump 306 is configured to pump fluid when rotated by the motor 122 via the coupling 126. In this instance, however, the pump 306 is configured as a power screw 308 carrying a piston 310 threadingly received onto the power screw 308. The outer perimeter of the piston 310 seals with an interior wall of the cylinder housing 202 (e.g., by close passage to the interior wall and/or with seals along the perimeter of the piston 310). As the power screw 308 is rotated by the motor 122, it screws the piston 310 upward through the cylinder housing 302, drawing fluid, and solids entrained in the fluid, into the interior of the cylinder housing 302. Fluid above the piston 310 is evacuated upwards through one or more vent holes 314 (two shown) near the upper end of the cylinder housing 302. A closure 316 is provided in the open end 304 and is changeable between sealing against flow through the open end 304 and allowing flow through the open end 304. As above, the closure 316 can be a check valve oriented to allow fluid to enter the cylinder housing 302, and close to prevent fluid and solids from exiting the cylinder housing 302. For example, the check valve can be configured as a ball 318 having a larger diameter than the diameter of the open end 304. Other examples of closures and/or check valves are within the concepts herein.

In operation, the bailer tool 300 is run into the wellbore on wire to a specified depth. When the motor 122 is rotated, it turns the power screw 308, and in turn, screws the piston 310 upward through the cylinder housing 302. The piston 300 pumps fluid and debris into the cylinder housing 302 through the closure 316. When the motor 122 stops, the closure 216 closes and seals the debris inside the cylinder housing 302. Thereafter, the bailer tool 300 can be withdrawn to the surface and emptied.

Figure 4:
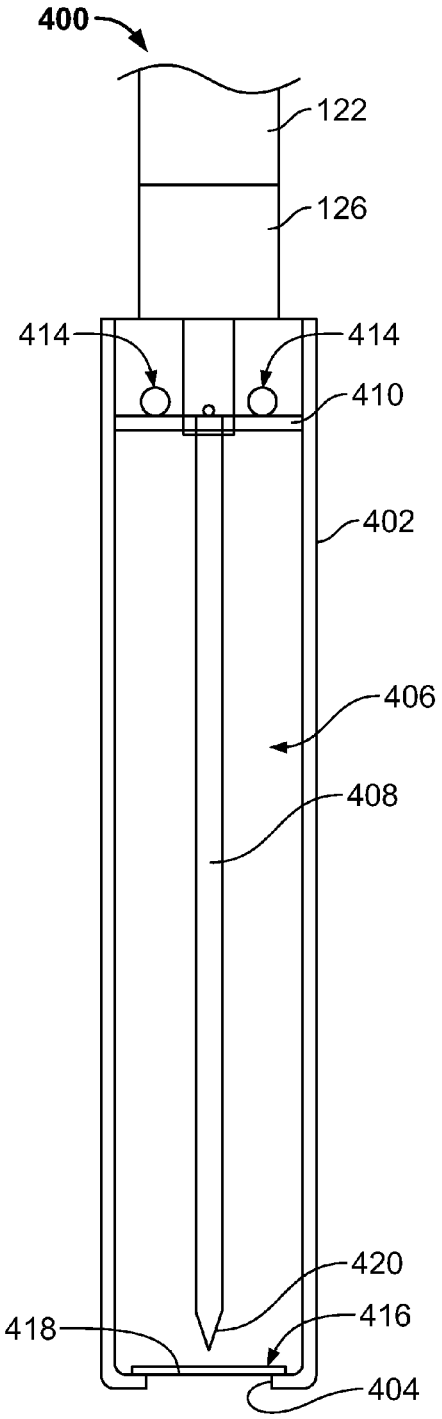
FIG. 4 is a half, side cross-sectional view of yet another example bailer tool configured as a dump bailer.

FIG. 4 is half, side cross-sectional view of another example bailer tool 400 that can be used as bailer tool 124. The bailer tool 400 is a dump bailer that carries material, such as cement and/or other material, downhole, and deposits the material in the wellbore. The bailer tool 400 includes a cylinder housing 402 defining an interior chamber and having an open end 404. A pump 406 is provided in the cylinder housing 402 and is coupled to the rotary motor coupling 126 and, in turn, to the motor 122. The pump 406 is configured to pump fluid in response to rotation of the motor 122 via the coupling 126. The pump 106 is configured as a power screw 308 carrying a piston 410 threateningly received onto the power screw 408. The outer perimeter of the piston 410 seals with an interior wall of the cylinder housing 402 (e.g., by close passage to the interior wall and/or with seals along the perimeter of the piston 410). As the power screw 308 is rotated by the motor 122 it screws the piston 410 downward through the cylinder housing 402, pushing the flowable material in the interior of the cylinder housing 402 out through the open end 404. One or more vent holes 414 (two shown) near the upper end of the cylinder housing 404 allow fluid in the wellbore to fill in behind the piston 410 as it moves downward through the cylinder housing 402. A closure 416 is provided in the open end 404 and is changeable between sealing against flow through the open end 404 and allowing flow through the open end 404. In certain instances, the closure 416 is a frangible plate 418 over the open end 404 that seals the flowable material in the cylinder housing 404. The frangible plate 418 is configured to break in response to pressure from the piston 410 moving the material out of the cylinder housing 402. Alternately, or additionally, the power screw 408 is configured to axially shift into the frangible plate 418 when operated by the motor 122, and break the frangible plate 418. In certain instances, the power screw 408 can have a sharp 420 to facilitate breaking frangible plate 418. Other examples of closures are within the concepts herein.

In operation, the bailer tool 400 is run into the wellbore on wire to a specified depth. When the motor 122 is rotated, it turns the power screw 408, and in turn, screws the piston 410 downward through the cylinder housing 402. The piston 410 pumps the material in the cylinder housing 402 outward through the closure 316, depositing the material in the wellbore. In an instance having a frangible plate 418, the frangible plate 418 is broken to allow the material to flow out of the cylinder housing 402. Thereafter, the bailer tool 400 can be withdrawn to the surface.

Figure 5:
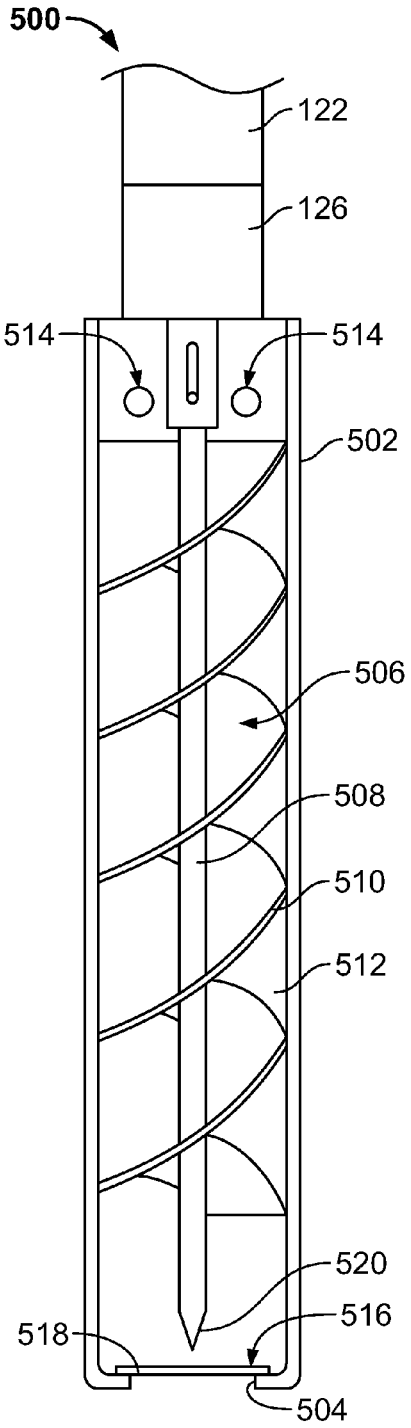
FIG. 5 is a half, side cross-sectional view of yet another example bailer tool, configured as yet another dump bailer.

FIG. 5 is a half, side cross-sectional view of yet another example bailer tool 500 that can be used as bailer tool 124. Like the bailer tool 400 of FIG. 4, the bailer tool 500 is a dump trailer that carries material, such as cement and/or other material, downhole, and deposits the material in the wellbore. The bailer tool 500 includes a cylinder housing 502 defining an interior chamber and having an open end 504. The pump 506 is provided in the cylinder housing 502 and is coupled to the rotary motor coupling 126 and in turn, to the motor 122. The pump 506 is configured to pump fluid in response to rotation of the motor 122 via the coupling 126. The pump 506 is configured as an auger screw having a central shaft 508 hearing helical blade 510 that extends outward from the shaft 508. The outer perimeter of the helical blade 510 seals with an interior wall of the cylinder housing 502 (e.g., by close passage to the interior wall and/or with seals along the perimeter of the blade 510), and defines a helical fluid chamber 512 substantially length of the pump 506. As the pump 506 is rotated by the motor 122, it pushes the material in the interior of the cylinder housing 502 out through the open end 504. One or more vent holes 514 (two shown) near the upper end of the cylinder housing 504 allow fluid in the wellbore to fill in behind the material as it moves downward through the cylinder housing 502. The closure 516 is provided in the open end 504 and is changeable between sealing against flow through the open end 504 and allowing flow through the open end 504. The closure 516 is a frangible plate 518 over the open end 504 that seals the flowable material in the cylinder housing 504. The frangible plate 518 is configured to breaking response to pressure from the screw moving the material out of the cylinder housing 502. Alternately, or additionally, the power screw 508 is configured to axially shift into the frangible plate 518 when operated by the motor 122, and break the frangible plate 518. In certain instances the power screw 508 can have a sharp tip 520 to facilitate breaking the frangible plate 518. Other examples of closures are within the concepts herein.

In operation, the bailer tool 500 is run into the wellbore on wire to a specified depth. When the motor 122 is rotated, it turns the power screw 508, and in turn, rotates the screw to pump material in the cylinder housing 502 out through the open end 504, depositing material in the wellbore. In an instance having a frangible plate 518 the frangible plate is broken to allow the material to flow out of the cylinder housing 402. Thereafter, the bailer tool 500 can be withdrawn to the surface.

Notably, bailer tool 400 (FIG. 4) and bailer tool 500 (FIG. 5) are positive displacement dump bailers, meaning that they use a positive displacement pump to push the materials in their respective cylinders out into the wellbore rather than relying solely on gravity. Often, with dump bailers that rely solely on gravity, the operator must jerk the dump bailer up and down via the wire to help displace the material into the wellbore. This jerking puts a large stress on the wire. In certain instances, because they are motorized, the tools 400, 500 need not be jerked in this manner to help displace the material into the wellbore.

A number of embodiments have been described. Nevertheless, it will be understood that various modifications may be made. Accordingly, other embodiments are within the scope of the following claims.

What is claimed is:

1. A wellbore bailer, comprising:

a rotary motor coupling;

a rotary downhole motor coupled to the rotary motor coupling, the rotary downhole motor comprising a downhole power unit configured to provide power to operate the rotary downhole motor in response to an actuation signal from an electrical conductor of a well wireline;

a cylinder having an open end;

a pump in the cylinder coupled to the rotary motor coupling and configured to pump fluid when rotated via the coupling, where the pump comprises a central shaft carrying a helical blade that extends outward from the shaft and defining a helical fluid chamber substantially the length of pump, and where the helical blade seals with an interior wall of the cylinder; and a closure changeable between sealing and allowing flow through the open end.

2. The wellbore bailer of claim 1, wherein the downhole power unit comprises a battery.

3. The wellbore bailer of claim 1, further comprising an electrical coupling coupled to the downhole motor and adapted to couple to the electrical conductor of the well wireline.

4. The wellbore bailer of claim 1, where the closure comprises a check valve.

5. The wellbore bailer of claim 4, where the check valve comprises a ball in the cylinder that seals the opening against flow out of the cylinder.

6. The wellbore bailer of claim 1, where the closure comprises a frangible plate.

7. The wellbore bailer of claim 6, where the pump is axially moveable into the frangible plate to break the frangible plate.

8. The wellbore bailer of claim 1, where the pump is configured to pump fluid out of the cylinder when rotated via the coupling.

9. The wellbore bailer of claim 1, where the pump is configured to pump solids entrained in fluid into the cylinder when rotated via the coupling.

10. The wellbore bailer of claim 1, further comprising an actuator to trigger the motor based on pressure or time.

11. The wellbore bailer of claim 1, where the downhole power unit is configured to provide electric power to operate the rotary downhole motor.

12. The wellbore bailer of claim 11, where the downhole power unit is configured to provide electric power to operate the rotary downhole motor independent of power provided through the well wireline.

13. The wellbore bailer of claim 1, where the pump is configured to operate independently of a jerking movement of the well wireline.

14. A method, comprising:

rotating a pump of a wellbore bailer with a downhole motor, the downhole motor comprising a downhole power unit that provides power to operate the downhole motor in response to an actuation signal from an electrical conductor of a well wireline, where rotating the pump of a wellbore bailer with the downhole motor comprises rotating a central shaft carrying a helical blade that extends outward from the shaft defining a helical fluid chamber substantially the length of the pump, and where the helical blade seals with an interior wall of a cylinder of the pump;

in response to rotating the pump, pumping fluids between a wellbore and the helical fluid chamber, where pumping fluids between a wellbore and a chamber of the wellbore bailer comprises pumping fluids out of the chamber into the wellbore; and shifting the pump axially to break a frangible plate sealing the chamber.

15. The method of claim 14, where rotating the pump of the wellbore bailer with the downhole motor comprises powering the downhole motor with a battery of the downhole power unit.

16. A wellbore bailer, comprising:

a cylinder having a central bore, an open end, and a vent hole;

a pump residing in the central bore of the cylinder, the pump comprising a rotatable central shaft carrying a helical blade that extends outward from the shaft and defining a helical fluid chamber substantially the length of pump, the helical blade sealing with an interior wall of the cylinder, a closure changeable between sealing and allowing flow through the open end of the cylinder;

a rotary downhole motor operatively coupled to the shaft of the pump via a rotary motor coupling and configured to rotate the shaft to pump fluid and solids entrained in the fluid into the bore of the cylinder towards the vent hole, and further configured to rotate the shaft at a speed that allows the helical blade to cause the solids entrained in the fluid to settled out of the fluid within the helical fluid chamber as the fluid is pumped towards the vent hole.

17. The wellbore bailer of claim 16, wherein the rotary downhole motor comprises a downhole power unit configured to provide power to operate the rotary downhole motor in response to an actuation signal.

18. The wellbore bailer of claim 17, wherein the downhole power unit comprises a battery.

19. The wellbore bailer of claim 16, wherein the rotary motor coupling comprises a gear system to drive the shaft at a different rotational speed than the rotary downhole motor.

* * * * *